US005368436A

United States Patent [19]

Freiburger

[11] Patent Number: 5,368,436

[45] Date of Patent: Nov. 29, 1994

[54] METHOD FOR TRANSPORTING WASTE MATERIAL

[76] Inventor: Gene Freiburger, R.R. 1, Lisbon, Iowa 52253

[21] Appl. No.: 931,207

[22] Filed: Aug. 17, 1992

[51] Int. Cl.[5] ..... B65F 3/04; B65D 88/12

[52] U.S. Cl. ..... 414/786; 414/408; 414/406

[58] Field of Search ..... 414/406, 407, 408, 487, 414/786

[56] References Cited

U.S. PATENT DOCUMENTS

| | | | |
|---|---|---|---|
| 3,195,942 | 7/1965 | Dempster et al. | 414/408 X |
| 3,353,696 | 11/1967 | Goodman . | |
| 3,632,000 | 1/1972 | Hotta | 414/487 |
| 4,310,279 | 1/1982 | Johnston | 414/408 |
| 4,840,531 | 6/1989 | Dinneen | 414/409 |
| 4,915,570 | 4/1990 | Rath et al. | 414/487 X |
| 4,978,271 | 12/1990 | Seader | 414/487 |
| 4,981,411 | 1/1991 | Ramsey | 414/487 |
| 5,035,563 | 7/1991 | Mezey | 414/409 |
| 5,035,564 | 7/1991 | Matsumoto | 414/487 X |
| 5,094,582 | 3/1992 | Molzhon | 414/408 X |
| 5,122,025 | 6/1992 | Glomski | 414/408 X |

FOREIGN PATENT DOCUMENTS

| | | | |
|---|---|---|---|
| 1264702 | 1/1990 | Canada | 414/406 |
| 314238 | 5/1989 | European Pat. Off. | 414/406 |
| 405428 | 1/1991 | European Pat. Off. | 414/408 |

*Primary Examiner*—Michael S. Huppert
*Assistant Examiner*—J. Eller
*Attorney, Agent, or Firm*—Laff, Whitesel, Conte & Saret

[57] ABSTRACT

A method for transforming a refuse vehicle into a combination refuse disposal and recycling vehicle, the refuse disposal vehicle having a cab portion and a rearwardly disposed container on a chassis, the rearwardly disposed container having a single compartment extending substantially the length thereof for holding and compacting refuse material, comprising the step of: movably attaching a bin to at least one side of the rearwardly disposed container, the bin being located beneath the rearwardly disposed container and for holding recyclable material. The combination vehicle that is transformed by the above method.

9 Claims, 5 Drawing Sheets

METHOD FOR TRANSPORTING WASTE MATERIAL

FIELD OF THE INVENTION

This invention relates to a method and an apparatus for transporting waste material. More particularly, this invention relates to a method of retrofiting conventional refuse disposal trucks and further relates to the trucks that are retrofit by this method.

BACKGROUND OF THE INVENTION

Vehicles for transporting waste are expensive and important components in the control of waste. As municipalities and industry grow, the waste generated by them also grows. Moreover, environmental concerns of a growing population and dwindling land supply combine to limit the size of garbage dumps. Thus, to combat the ever-increasing volume of waste, waste recycling trucks are becoming increasingly important and receiving extensive attention due to widespread efforts to minimize the waste intended for garbage dumps by increasing the amount of recyclable material.

Recycling trucks are different from conventional refuse disposal trucks in both function and design. For example, refuse trucks hold waste material that is not recyclable and are typically loaded through a single compartment in the rear of the truck. Conversely, recycling trucks; hold waste material that is specially processed and then reused, including materials such as glass, aluminum, paper, tin and plastic and are generally loaded through compartments located on one side of the truck. Recycling trucks may also be used to contain yard waste material, such as grass clippings, tree trimmings and mulch.

A variety of recycling trucks are known. Most of these recycling trucks are separate from the refuse disposal trucks. However, at least one recycling truck is known which houses both refuse and recyclable materials. For example, U.S. Pat. No. 4,978,271 ('271) discloses a structurally modified vehicle with both a rearwardly loaded compactor section for refuse and an apparatus for recyclable material. The recycling apparatus in that patent includes a pair of lower and upper containers that are located on both sides of the vehicle. Each lower container includes a side opening and each upper container has a top opening. Recyclable material is loaded into the lower container through the side opening. The lower container is then emptied by hydraulically lifting and inverting it above the upper container to align the respective openings for transferring material between the containers.

While the aforementioned '271 vehicle holds both refuse and recyclable materials, there are problems associated with its use. For example, the '271 vehicle has been structurally modified to accommodate the recycling equipment which is both costly and time-consuming to implement. Moreover, the lower container of the '271 recycling apparatus has limited storage room and must frequently be emptied into the upper container. This is both inefficient and time-consuming. These and other disadvantages with the above-mentioned refuse/recycling truck preclude widespread acceptance or usage.

Accordingly, an object of the present invention is to provide a combination vehicle for simultaneously transporting both refuse and recyclable material.

It is another object of the present invention to provide a combination vehicle for transporting refuse and recyclable material that has not been structurally modified.

Yet another object of the present invention to provide a combination vehicle for transporting refuse and recyclable material which is economical to operate.

SUMMARY OF THE INVENTION

The present invention, in a preferred embodiment, accomplishes the foregoing objects by providing a method for transforming a conventional or pre-existing refuse disposal vehicle into a single, combination refuse disposal and recycling vehicle. The present invention also encompasses the combination vehicle that is transformed by this method. Thus, the inventive method and combination vehicle thereby combine the containment of both refuse and recyclable material in a conventional disposal truck that has not been structurally modified.

The aforementioned combination vehicle includes a cab portion and a rearwardly disposed container mounted on a chassis. The combination vehicle further includes a first compartment for holding refuse and a second compartment for holding recyclable material. A third compartment may also be included for holding yard waste or other recyclable materials.

The first compartment is located within and extends substantially the length of the rearwardly disposed container for holding refuse material. The refuse material is compacted within the first compartment and is removed therefrom by ejection or, alternatively, by gravitation caused by tilting the container.

The second compartment is located beneath and movably attached to at least one side of—but preferably both sides of—the rearwardly disposed container for holding recyclable material. The second compartment is attached to the sides of the rearwardly disposed container by hydraulic arms. Each bin is divided into sections and includes a plurality of openings associated with each section for receiving different recyclable materials. The second compartment is positioned beneath and on opposite sides of the rearwardly disposed container for collection purposes and is emptied by hydraulically elevating it above or level with the rearwardly disposed container to release its contents into a separate container through a partially detachable bottom. The second compartment includes a collapsible bottom surface that enables the compartment to be lowered or raised, if necessary, to prevent its bottom from scraping the ground at the waste facility. The second compartment is preferably a bin.

The third compartment is forwardly disposed of and may be movably attached to the truck frame adjacent the cab portion for holding yard waste or additional recyclable materials. The third compartment may be sectioned for separately holding different materials. The third compartment is lowered during use and elevated during non-use and is preferably a bin.

Thus, the invention provides for a method for transforming a conventional refuse disposal vehicle into a combination refuse disposal and recycling vehicle. The invention also provides for the combination vehicle that is transformed by this method. Thus, the inventive method and combination vehicle thereby combine the containment of both refuse and recyclable material in a conventional disposal truck that has not been structurally modified.

The above, as well as other objects and advantages of the invention, will become apparent from the following detailed description of the embodiments, reference being made to the accompanying drawings.

DETAILED DESCRIPTION OF THE INVENTION

Figure 1:
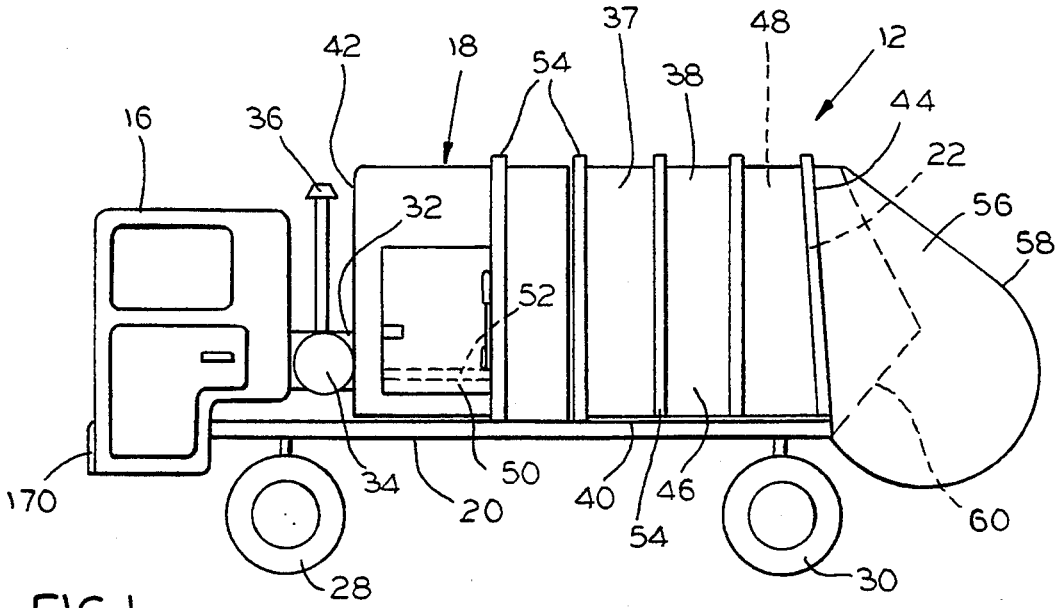
FIG. 1 is a side view of a conventional refuse disposal vehicle.
Figure 2:
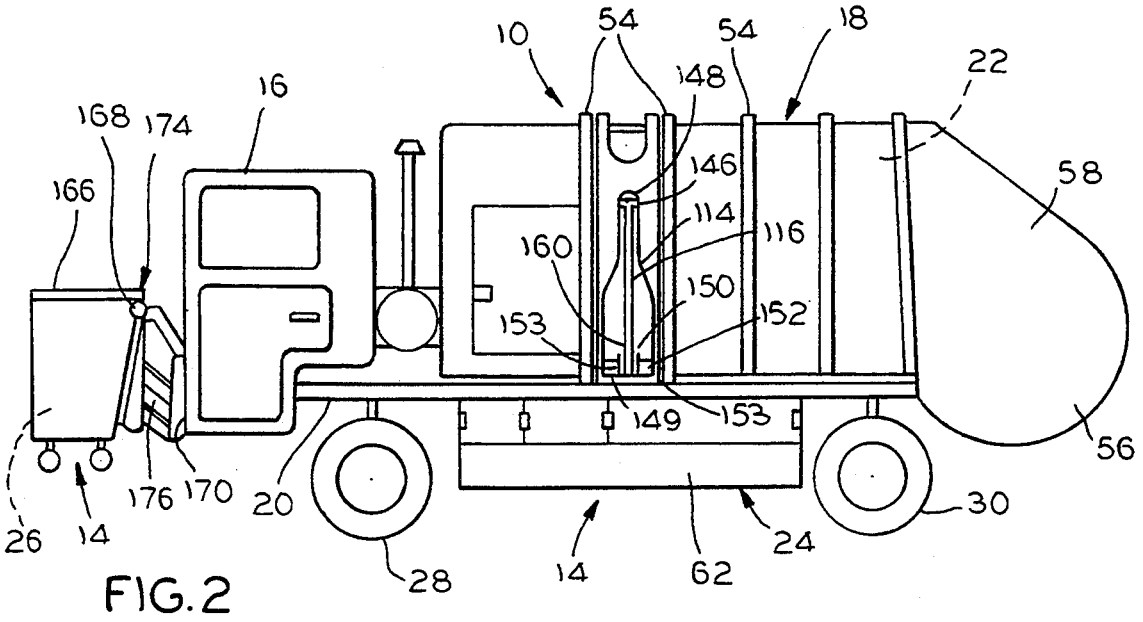
FIG. 2 is a side view of the preferred embodiment of the inventive combination refuse disposal and recycling vehicle.

Generally referring to FIGS. 1 and 2, the invention in a preferred embodiment provides a vehicle, denoted by the numeral 10, which has been transformed from a conventional refuse disposal vehicle 12 (FIG. 1) into a combination refuse disposal and recycling vehicle (FIG. 2) by using recycling equipment 14 to retrofit the conventional vehicle. Combination vehicle 10 and conventional vehicle 12 both include, in part, a cab portion 16 and a rearwardly disposed container 18 mounted on a chassis 20. A first compartment 22 is located within and extends substantially the length of the rearwardly disposed container in both vehicles for holding refuse material. However, as a result of the above-mentioned transformation, combination vehicle 10 additionally includes a second compartment 24 which is movably attached to at least one side of and located beneath the rearwardly disposed container for holding recyclable material. Combination vehicle 10 may also include a third compartment 26 which is forwardly disposed of and movably attached to a truck frame (not shown) adjacent to cab portion 16 for holding yard waste material or additional recyclable materials. The above second and third compartments, 24, 26, respectively, individually and collectively comprise the recycling equipment 14 of combination vehicle 10.

Referring first to FIG. 1, conventional refuse disposal vehicle 12 includes the previously mentioned cab portion 16 and rearwardly disposed container 18 which are mounted on chassis 20. A pair of front wheels 28 and rear wheels 30 are rotatably attached to chassis 20. An engine 32, hydraulic system 34 and exhaust 36 are located above chassis 20 and between cab portion 16 and rearwardly disposed container 18.

Rearwardly disposed container 18 of conventional vehicle 12 includes a generally rectangular body 37 having a top surface 38, a bottom 40, a front 42, a rear 44, a first side 46 and a second side 48. First compartment 22 of rearwardly disposed container 18 is located within and extends substantially from rear 44 towards front 42 along the length of the container for holding refuse. Adjacent first compartment 22 is an auxiliary compartment 50 which houses, in part, a hydraulic ram 52 for ejecting the contents of rearwardly disposed container 18. Alternatively, the contents of container 18 may be gravitationally removed therefrom by tilting the container.

A plurality of evenly spaced external support members 54 circumscribe body 37 of rearwardly disposed container 18 for reinforcement. A hopper 56 with tailgate 58 extends outwardly from rear 44 of rearwardly disposed container 18 and includes an internally located packing blade 60.

Conventional vehicle 10 is transformed from a vehicle which holds only refuse into combination vehicle 12 which holds both refuse and recyclable material. This transformation is accomplished by using recycling equipment 14 to retrofit the conventional vehicle. As previously mentioned, recycling equipment 14 includes second compartment 24 which is movably attached to at least one side of and located beneath the rearwardly disposed container between front and rear wheels 28, 30, respectively. Recycling equipment 14 also preferably includes third compartment 26 which is forwardly disposed and movably attached to the truck frame adjacent to cab portion 16. Thus, conventional vehicle 10 is transformed into combination vehicle 12 by attaching second compartment 24 and, preferably, third compartment 26 to conventional vehicle 10.

Figure 3:
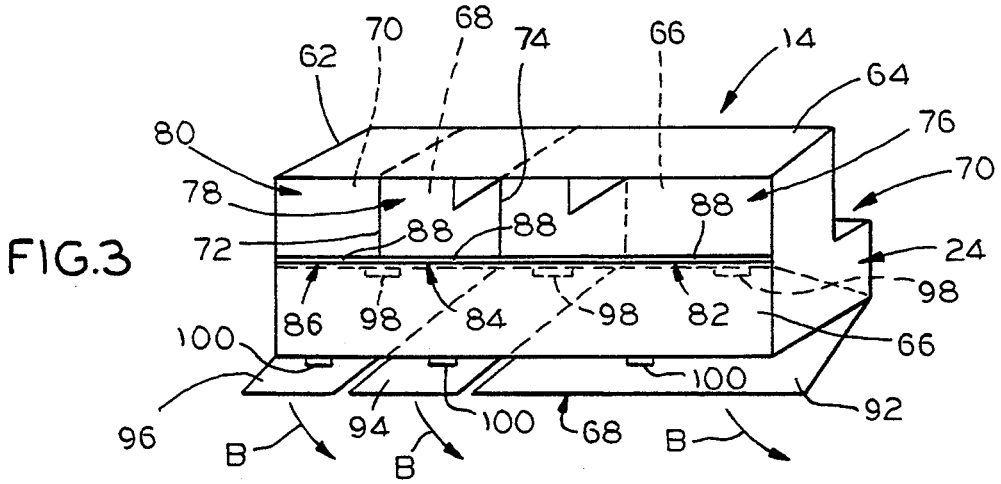
FIG. 3 is a perspective view of the container for holding recycling material, illustrating the bottom flaps as they move to an open position.
Figure 4:
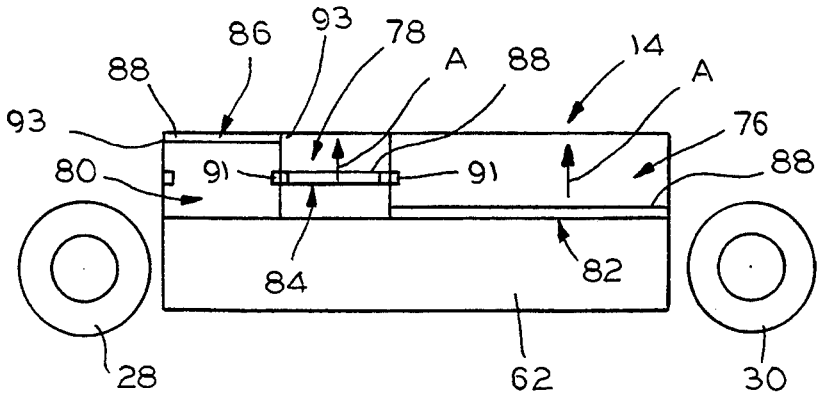
FIG. 4 is a partial side view of the container of FIG. 3, illustrating the covers in open and closed positions.
Figure 5:
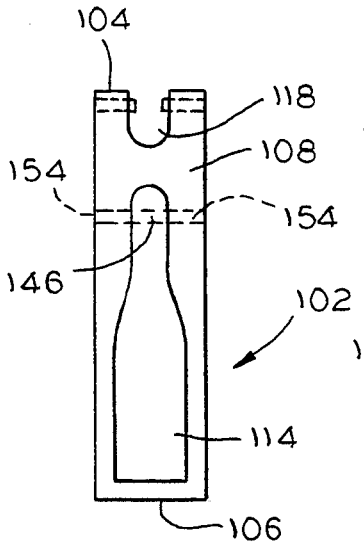
FIG. 5 is a front view of the inventive lift arm.
Figure 6:
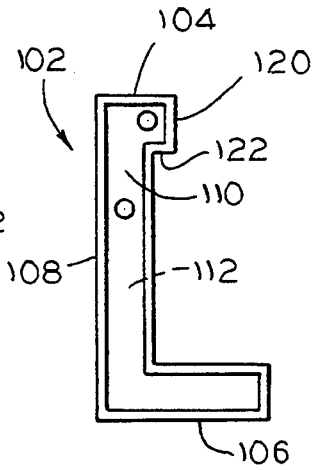
FIG. 6 is a side view of the lift arm of FIG. 5.
Figure 7:
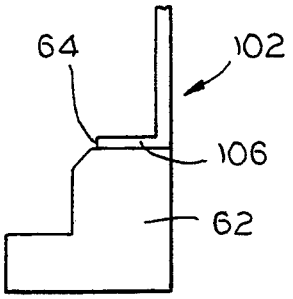
FIG. 7 is a side view of the container of FIG. 3 and the bottom portion of the lift arm of FIG. 5.

Referring to FIGS. 2–4, second compartment 24 comprises a bin 62 having a stepped configuration which prevents interference with chassis 20 during the collection process when bin 62 is stored beneath first compartment 22. Bin 62 includes, in part, an upper or topmost surface 64, an outer or front side 66 and a collapsible bottom surface 68. A stepped portion 70 is located adjacent topmost surface 64. Bin 62 further includes a compartmentalized interior with a first section 67, a second section 71 and a third section 73 that are separated by partitions 72 and 74. First section 67 is generally larger than the second or third section.

Sections 67, 71, 73 are accessible through openings 76, 78, 80 on outer side 66 of bin 62 which are preferably located on the upper half of the bin. Each opening includes a slidably mounted cover 82, 84, 86, as indicated by arrows A in FIG. 4. A lip 88 projects horizontally outwardly from the cover and secures each cover in various positions within the openings by locking into a plurality of latching mechanisms 90 that are positioned on opposite sides of each opening at intermediate and upper levels, 91, 93 respectively. The latching mechanisms and/or the bottom of each opening, in combination with lip 88, regulate the downward movement of the cover within the opening. Lip 88 also provides a means to manually raise and lower the covers within their respective openings.

Figure 18:
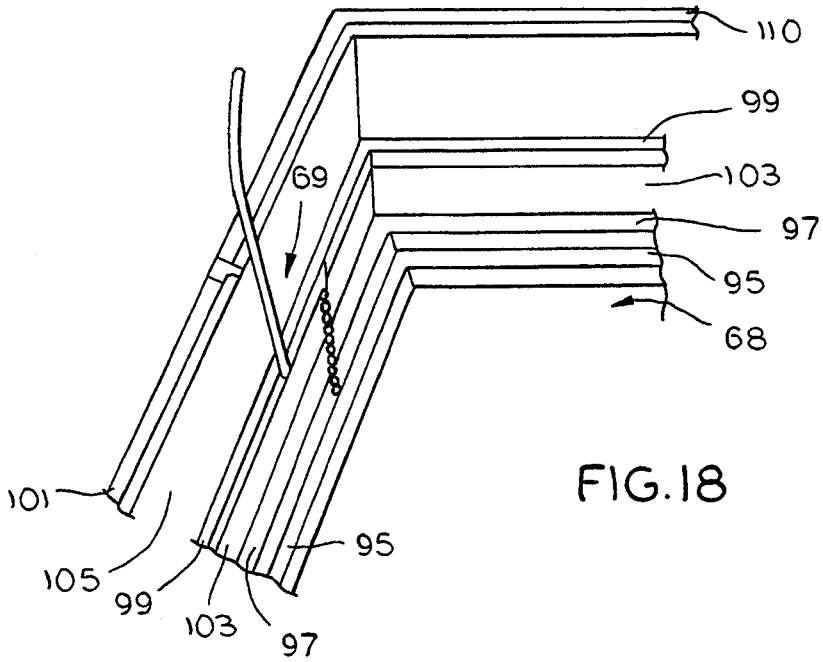
FIG. 18 is a partial perspective view of the interior of the container of FIG. 3.
Figure 19:
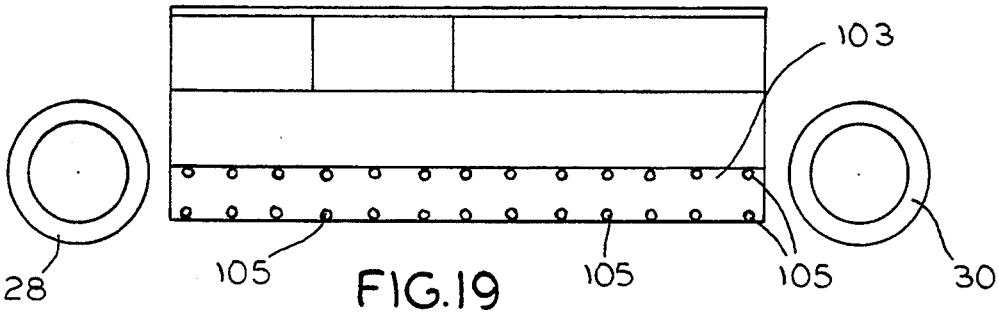
FIG. 19 is a side plan view of the container of FIG. 3, illustrating the container in a lowered position.
Figure 20:
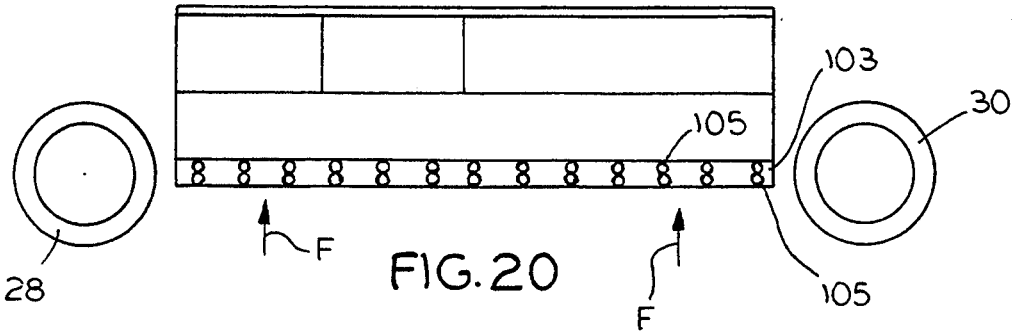
FIG. 20 is a side plan view of the container of FIG. 3, illustrating the container in a raised position.

Collapsible bottom surface 68 is vertically displaceable within bin 62 by mechanism 69 and includes a first square tube frame 95 that circumscribes a bottom area 97 (see FIG. 18). First frame 95 is fastened within and conforms to a second square tube frame 97 which extends along the inside and bottom of bin 62. A third and fourth square tube frame, 99 and 101, respectively, are spaced apart and located above second square tube frame 97 along the inside of bin 62. A canvaslike or other flexible material 103 separates and is attached to second frame 97 and third frame 99 by a plurality of self-tapping screws 105 (see FIGS. 19 and 20). The remainer of bin 62 is preferably made from metal or hard plastic.

Vertical displacement mechanism 69 includes an interconnected handle 107 and arm support 109 which are pivotally connected by a bolt 111 or other fastening means to third square tube frame 99. A connection mechanism 113, such as a chain, joins arm support 109 with a clasp 115 which is permanently attached to first frame 95. A locking mechanism 117 is fixedly attached to fourth frame 101 and is used to anchor handle 107. In the preferred embodiment, vertical displacement mechanism 69 is located adjacent each end of bin 62.

Bottom surface 68 of bin 62 is formed by a plurality of individual hinged flaps 92, 94, 96 which extend beneath and correspond to aforementioned sections 67, 71, 73. The flaps are attached to first square tube frame 95 of bin 62 by a hinge mechanism 98 which is located on first frame 95 at either the rear or front of each bin. A latching mechanism 100, such as a rotating pin, is located on the side of bin 62 opposite hinge mechanism 98 and is used to securely lock each flap to the bin. The flaps open from one side and rotatably move towards the other side of the bin, as for example, in the direction indicated by arrows B in FIG. 3.

Figure 21:
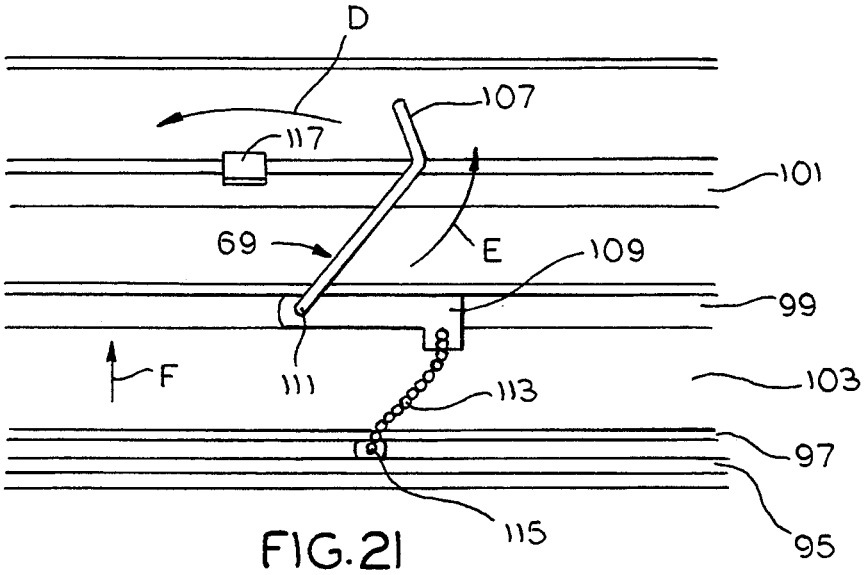
FIG. 21 is a partial plan view of the interior of the container of FIG. 18, illustrating the bottom surface in a lowered position.
Figure 22:
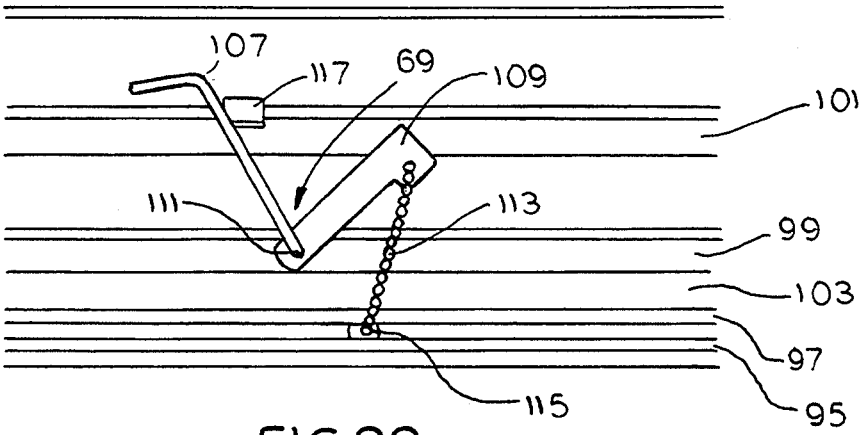
FIG. 22 is a partial plan view of the interior of the container of FIG. 18, illustrating the bottom surface in a raised position.

Collapsible bottom surface 68 is vertically displaced by manually pulling handle 107 towards and into contact with locking mechanism 117 (see FIG. 22), in the direction indicated by arrow D in FIG. 21. The lateral movement of handle 107 causes arm support 109 to move upwardly, in the direction indicated by arrow E in FIG. 21. This, in turn, causes flexible material 103 to yield and connection mechanism 113 to vertically displace bottom surface 68 in an upward direction, as indicated by arrows F in FIGS. 20 and 21. Bottom surface 68 is lowered by moving handle 107 in a direction opposite to that described above.

Bin 62 is preferably attached to both sides of rearwardly disposed container 14 by a lift arm 102. Referring to FIGS. 5–9, lift arm 102 is generally U-shaped in profile and includes, in part, a top extension 104, a lower extension 106, a front 108 and sides 110, 112. Lift arm 102 includes two different apertures along its surfaces. The first aperature 114 is elongated and extends across front 108 and substantially along the length of lift arm 102 to accommodate a hydraulic cylinder 116 (which is discussed later) and to minimize the weight of the lift arm. Furthermore, aperture 114 narrows at the top of lift arm 102 to accommodate different stresses in the lift arm. The second aperture 118 is U-shaped and is located on both top extension 104 and front 108 of lift arm 102 at their point of intersection.

Lift arm 102 is preferably formed by welding together two plates 120, 122 (see FIG. 6) or, alternatively, is formed by cutting and welding together dimensional steel, such as square tubing (not shown).

Lift arm 102 is mounted to side 46 and/or side 48 of rearwardly disposed container 18 preferably between the first two forwardly disposed external support members 54. Top extension 104 of lift arm 102 is pivotally mounted to top surface 38 (see FIG. 9), whereas lower extension 106 is pivotally mounted to topmost surface 64 of bin 62 (see FIG. 8), as is discussed in greater detail below.

Referring to FIGS. 2 and 9–11, top extension 104 is nested between the first and second forwardly disposed support members 54. Top extension 104 includes two identical arms 124, 126 which are each pivotally mounted to a pair of tandem upper brackets 128 by a pivot pin 130 which extends through the arms and into the brackets. The brackets are L-shaped and are welded to an angled upper plate 132 which covers a portion of top surface 38 and sides 46, 48 of rearwardly disposed container 18 at their point of intersection.

Figure 9:
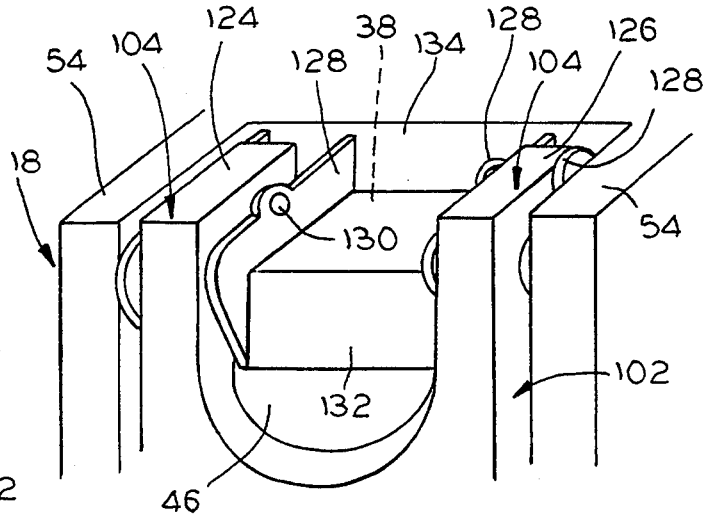
FIG. 9 is a partial perspective view of the top of the lift arm of FIG. 5 as it would appear attached to the top of the combination vehicle.
Figure 10:
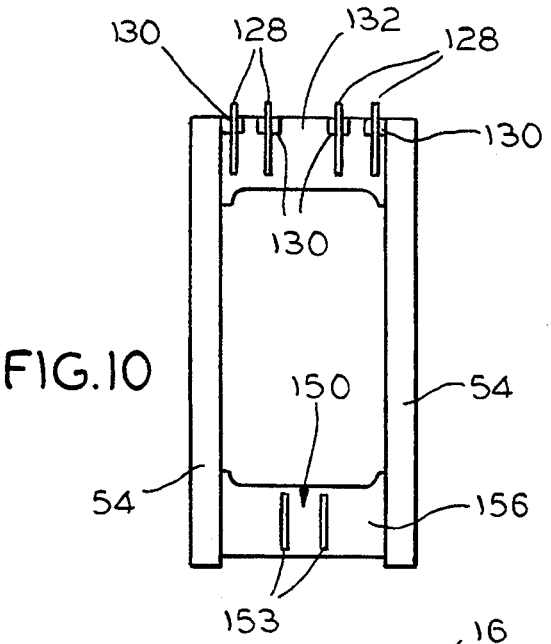
FIG. 10 is a front view of the upper and lower plates and brackets that support the lift arm of FIG. 5.
Figure 11:
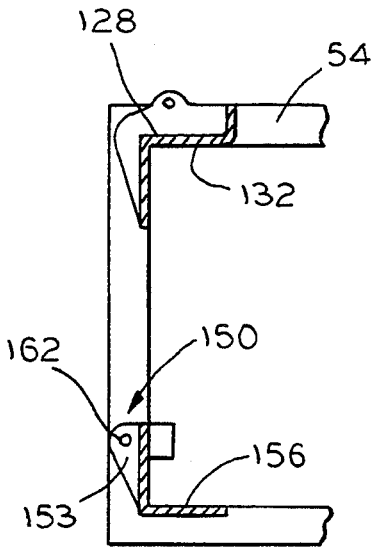
FIG. 11 is a side view of the plates and brackets of FIG. 10.

A reinforcing member 134 extends across top surface 38 of rearwardly disposed container 18 to additionally strengthen and prevent bowing in support members 54 (see FIG. 9). The reinforcing member does not have to be a separate plate but may be a continuation of angled upper plate 132.

Figure 8:
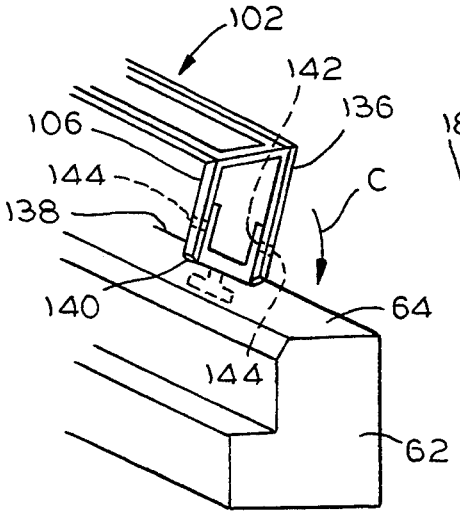
FIG. 8 is a partial perspective view of the container and lift arm of FIG. 7.

Lower extension 106 of lift arm 102 includes two identical arms 136, 138 which are pivotally mounted to a U-shaped mount 140 in topmost surface 64 of bin 62 by pivot pins 142 which extend from mount 140 into openings 144 in arms 136, 138. As shown in FIG. 8, lower extension 106 pivots in the direction indicated by arrow C when the bin is lowered for storage beneath rearwardly disposed container 18. Thus, lower extension 106 is parallel to and flush with topmost surface 64 of bin 62 when bin 62 is positioned beneath rearwardly disposed container 18 (see FIG. 7). Conversely, lower extension 106 forms an acute angle with topmost surface 64 when bin 62 is raised above rearwardly disposed container 18.

Referring to FIG. 2, lift arm 102 is moved by hydraulic cylinder 116 which is pivotally mounted within first aperture 114 of the lift arm by a first cylinder pin 146 at its upper end 148 and a second cylinder pin 149 and a cylinder mount 150 at its lower end 152. The first cylinder pin traverses the upper portion aperture 114 and extends into and through channels 154 located in the lift arm (see FIG. 5). The cylinder mount 150 is located at the bottom portion of aperture 114 and includes two symmetrical brackets 153 that are arranged in tandem. The brackets 153 welded or otherwise attached to a lower backing plate 156 (see FIG. 11) which in turn is welded directly to the sides and bottom of rearwardly disposed container 18. The second cylinder pin 149 extends through a channel 160 in hydraulic cylinder 116 and into openings 162 in brackets 152.

Figure 12:
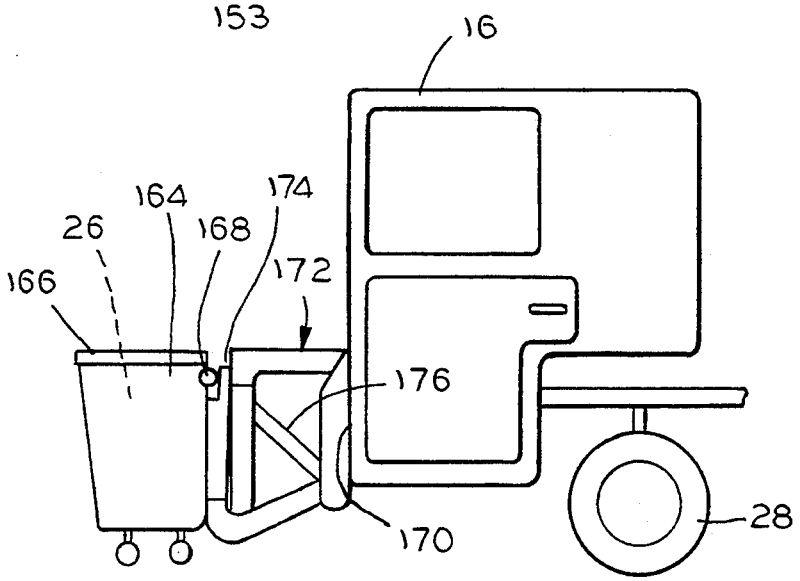
FIG. 12 is a partial side view of the combination vehicle of FIG. 2, illustrating the container for holding yard waste.

Recycling equipment 14 of combination vehicle 10 preferably includes third compartment 26 which is forwardly disposed of and movably attached to the truck frame adjacent to cab portion 16 for holding yard waste material or other recyclable material. Third compartment 26 may include a sectioned interior for separately holding different materials. Third compartment 26 may be located within any enclosed structure, such as container 164 shown in FIGS. 2 and 12. The container or other comparable structure, however, should not extend beyond the dimensions of the width of cab portion 16.

Container 164 preferably includes a hinged cover 166 and symmetrical arm extensions 168 which project outwardly from the container. Container 164 is pivotally attached to a front section 170 of the truck frame adjacent cab portion 16 by a brace 172 which grips the arm extensions. Brace 164 may include a locking mechanism 174, such as a pin, for securing the arm extensions to the brace.

During non-use, container 164 is elevated by another hydraulic cylinder 176. Likeweise, during use, container 164 is lowered by hydraulic cylinder 176.

Figure 13:
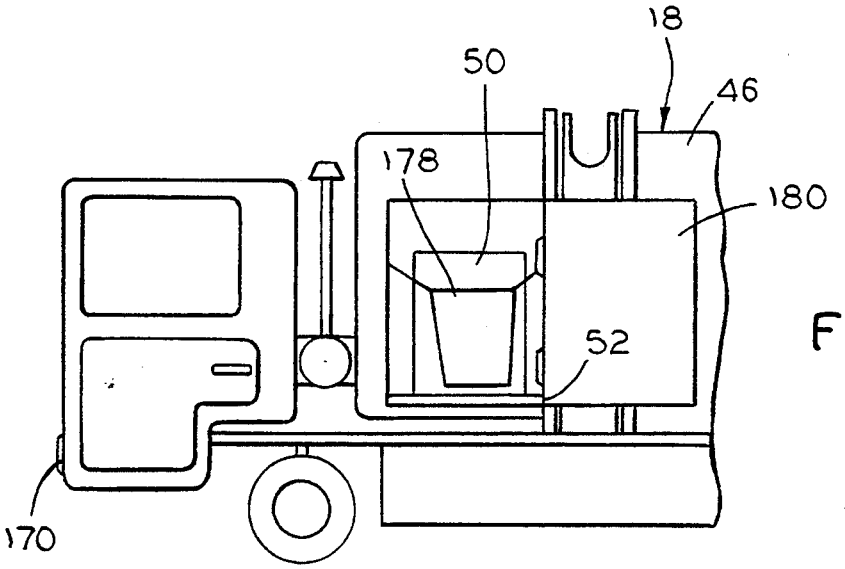
FIG. 13 is a partial side view of the combination vehicle of FIG. 2, illustrating the use of the auxiliary compartment for holding recyclable material.
Figure 14:
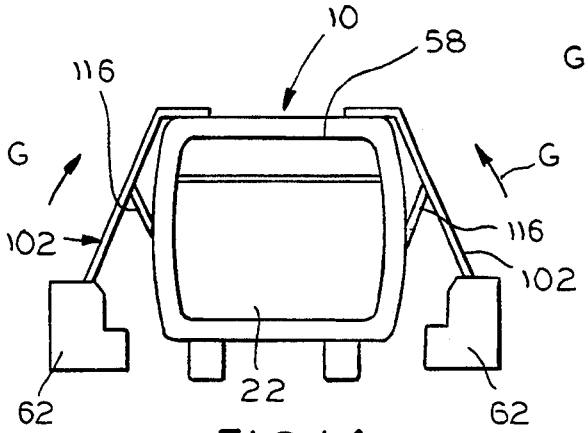
FIGS. 14, 15 and 16 are end views of the combination vehicle of FIG. 2, illustrating the sequential movement of the lift arms.
Figure 15:
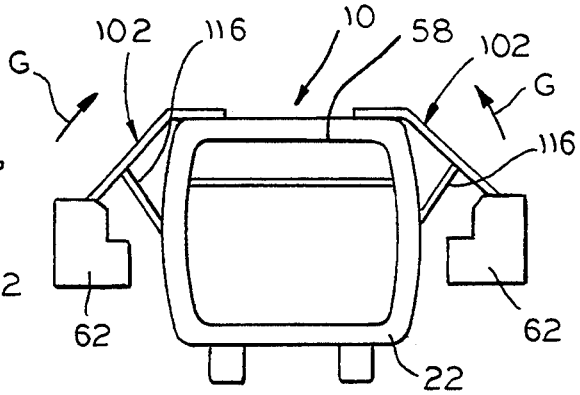
Figure 16:
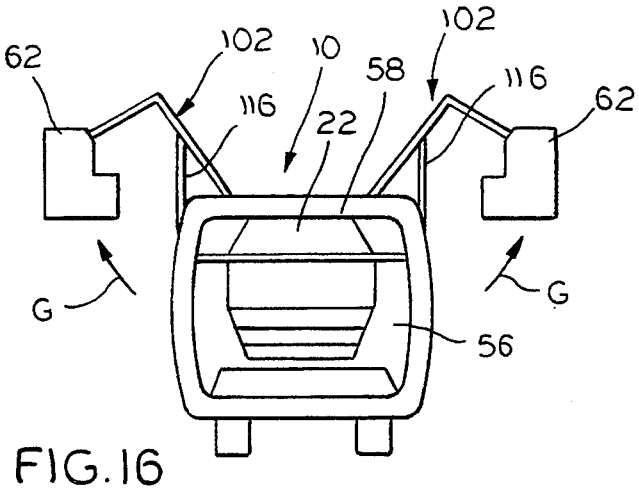

Referring to FIG. 13, combination vehicle may house additional recycling material in auxiliary compartment 50 of rearwardly disposed container 18. Preferably, a granulator or other similar apparatus (not shown) is located in auxiliary compartment 50 for on-location processing (i.e., size reduction) of recyclable materials, such as plastic, glass, or tin, so that storage space is maximized. Alternatively, a container 178, such as a bag, is placed in compartment 50 for holding recyclable materials such that it does not interfere with hydraulic ram 52 (see FIG. 13). Auxiliary compartment 50 is accessible through a hinged door 180 located on both first and second sides, 46, 48, respectively, of rearwardly disposed container 18.

Referring to FIGS. 14–17, in the use and operation of the preferred embodiment of the present invention, the first, second and third compartments are in an open position so that the specific waste material may be placed therein during the waste collection process. Thus, tailgate 58 of rearwardly disposed container 18 is open so that first compartment 22 is exposed for receiving refuse material. Likewise, bin 62 is positioned beneath rearwardly disposed container 18, and the openings to the various sections in the bin are uncovered for receiving recyclable material. Similarly, container 160 is lowered and its hinged cover is open for receiving yard waste and/or other recyclable material. Accordingly, as the operator of vehicle 10 makes the designated waste pick-ups, the different waste material is placed in the appropriate compartments, as is described in greater detail below.

Refuse material is placed through tailgate 58 into hopper 56 and first compartment 22. In contrast, recyclable material is placed into one the the various sections of bin 62 or into container 178 of auxilliary compartment 50. Thus, for example, paper material may be placed in first section 66, whereas glass and tin material may be deposited in second and third sections, 68, 70, respectively. Milk containers are usually placed in the granulator for on-location processing or in container 178 of auxiliary compartment 50. Because bins 62 are located on both sides of rearwardly disposed container 18, the operator of vehicle 10 may simultaneously collect waste from both sides of the street without delay and also without repositioning the vehicle. Finally, yard waste or other recyclable material is placed in container 164.

Figure 17:
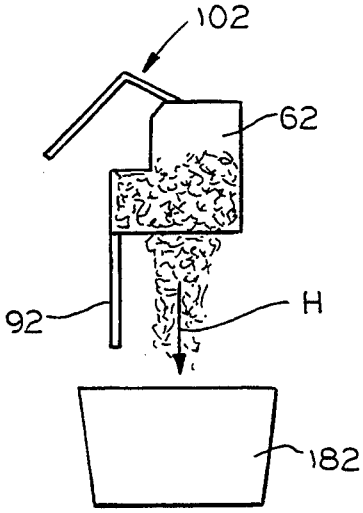
FIG. 17 is a partial side view of the container of FIG. 3, illustrating the emptying of its contents into a separate container.

After the different waste material has been collected, vehicle 10 is emptied at an appropriate facility. First, second compartment 24 is emptied by initially and simultaneously raising each bin on both sides of rearwardly disposed container 18 to a desired elevation with hydraulic cylinder 116, as shown by the arrows G in FIGS. 14–16. Once elevated, the contents of each bin are released into a separate container 182 by individually opening hinged flaps 92, 94, 96, as shown in FIG. 17 by arrow H. Next, the emptied bins are manually elevated, if necessary, to prevent their bottoms from scraping the ground at the facility. Finally, first compartment 22 of rearwardly disposed container 18 is emptied by hydraulically ramming it with hydraulic ram 52 so that its contents are ejected from the container through rear 44.

The yard waste or other recyclable material in container 164 may be emptied by lowering and releasing container 164 from brace 164. Likewise, any recyclable material in the granulator or in container 178 in auxiliarly compartment 50 may be emptied by manually removing part of the granulator or the entire container from vehicle 10.

The material from which combination vehicle 10 is contructed may include any conventional metal or hard plastic for bins 62 and container 164. Container 178 of auxiliary compartment 50 is preferably made of a strong, flexible material, such as burlap. Moreover, vehicle 10 has not been described in terms of approximate measurements, as it should be understood that the dimensions of the second and/or third compartments may vary to need.

Therefore, it should be recognized that, while the invention has been described in relation to a preferred embodiment thereof, those skilled in the art may develop a wide variation of structural details without departing from the principles of the invention. Accordingly, the appended claims are to be construed to cover all equivalents falling within the scope and spirit of the invention.

The invention claimed is:

1. A method for transforming a conventional refuse disposal vehicle into a single combination refuse disposal and recycling vehicle, the method comprising the steps of:

providing a conventional refuse disposal vehicle having a cab portion and a single refuse compartment rearwardly disposed container mounted on a chassis, said single refuse compartment extending substantially the length of said rearwardly disposed container for holding refuse material;

movably attaching a side bin for recyclable material to each side of said rearwardly disposed container, each said side bin extending beneath and substantially the length of said rearwardly disposed container;

providing each of said side bins with a plurality of separate compartments for receiving different recyclable materials; and providing each separate compartment with a hinged bottom for releasing the recyclable material within said separate compartments;

whereby said single refuse compartment may be loaded with refuse material, said separate compartments may be loaded with recyclable materials, and said recyclable materials may be emptied into a separate container located at a collection site by opening the hinged bottoms of the separate compartments to allow the recyclable materials contained in said separate compartments to fall into said separate container.

2. The method of claim 1, further comprising the step of movably attaching a forwardly disposed bin to a front portion of said cab portion for holding yard waste material or other recyclable material.

3. The method of claim 2, further comprising the step of providing the forwardly disposed bin with a plurality of separate compartments, each for receiving a different recyclable material.

4. The method of claim 1, wherein the step of movably attaching the side bins to each side of the rearwardly disposed container comprises the step of attaching each of the side bins to the rearwardly disposed container with a hydraulic arm.

5. The method of claim 4, wherein the step of emptying said recyclable materials comprises the step of elevating said side bin above said rearwardly disposed container for emptying the side bin of its contents.

6. The method of claim 1, further comprising the step of providing each of said side bins with a stepped configuration in which its widest and outer side is flush with an outer side of said rearwardly disposed container.

7. The method of claim 1, further comprising the steps of providing each of said separate compartments with a slidably mounted cover for covering and exposing said compartments.

8. The method of claim 1, further comprising the step of providing a hydraulic ram in a forwardly disposed separate interior compartment of said rearwardly disposed container for ejecting and emptying the refuse material from said rearwardly disposed container.

9. The method of claim 8, further comprising the step of placing additional recyclable materials in said interior compartment.

* * * * *